US006357051B1

(12) United States Patent
Lee

(10) Patent No.: US 6,357,051 B1
(45) Date of Patent: Mar. 19, 2002

(54) CAP HAVING A FOLDABLE VISOR

(75) Inventor: Seung Ho Lee, Seoul (KR)

(73) Assignee: Yushin Corp., Seoul (KR)

( * ) Notice: Subject to any disclaimer, the term of this patent is extended or adjusted under 35 U.S.C. 154(b) by 0 days.

(21) Appl. No.: 09/705,673

(22) Filed: Nov. 3, 2000

(30) Foreign Application Priority Data

Sep. 8, 2000 (KR) ..... 00-53429

(51) Int. Cl.[7] ..... A42B 1/00
(52) U.S. Cl. ..... 2/195.1; 2/195.6
(58) Field of Search ..... 2/12, 195.1, 209.13, 2/209.11, 171.1, 200.3, 209.12, 10, 175.1, 195.6

(56) References Cited

U.S. PATENT DOCUMENTS 893,548 A * 7/1908 Rosenfeld ..... 2/12
4,549,316 A * 10/1985 Johnson ..... 2/195
4,694,506 A * 9/1987 Perna ..... 2/12
5,450,629 A * 9/1995 Gilstrap ..... 2/209.11
5,991,916 A * 11/1999 Sierra ..... 2/12

* cited by examiner

*Primary Examiner*—John J. Calvert
*Assistant Examiner*—Katherine Moran
(74) *Attorney, Agent, or Firm*—Akin, Gump, Strauss, Hauer & Feld, L.L.P.

(57) ABSTRACT

According to the present invention, a cap having a foldable visor is provided, the cap comprising a visor core and cloth fixed to a upper surface and a lower surface of the visor core, the visor located in a wearer's forehead portion when the wearer wears the cap, wherein said visor core is divided into a plurality of pieces and is foldable about the dividing portions of the visor core, and wherein each cloth with sizes of said divided pieces of said visor core is fixed to one surfaces of the upper and lower surfaces of said divided pieces of said visor core, and a cloth with a total size of said divided pieces of said visor core in a state that said divided pieces of said visor core are adjacent to each other is fixed to the other surfaces of the upper and lower surfaces of said divided pieces of said visor core, so that a gap is formed between said divided pieces of said visor core and said cloth with a total size of said divided pieces of said visor core.

3 Claims, 6 Drawing Sheets

CAP HAVING A FOLDABLE VISOR

TECHNICAL FIELD

The present invention relates to a cap, more particularly, the present invention relates to a cap having a foldable visor, which is capable of being conveniently kept and carried and which is capable of forming a purse for keeping a small object.

BACKGROUND OF THE INVENTION

As air pollution is deepening, an ozone layer is destroyed, thereby attacks of the skin cancer and the skin disease due to ultraviolet (UV) rays are increasing more and more. In order to intercept the UV rays, products such as UV shielding agent have been developed. However, the best mode for preventing injury due to the UV rays is to avoid the intensive sunlight.

As those who works on fields or those who plays on playgrounds are subject to exposure to the intensive sunlight, they wear a cap to protect their faces from the UV rays.

FIG. 1 is a perspective view of a cap according to the conventional art, and FIG. 2 is a cross-sectional view taken along line A–A' of the cap visor shown in FIG. 1.

As shown in FIG. 1 and FIG. 2, in wearing a cap 1 on one's head, a cap visor 4 is positioned toward a front of a wearer's forehead and thus shade of the cap visor 4 is formed on his face. Like this, the cap visor 4 intercepts the sunlight intensively beat down from the sun to protect the face from the UV rays.

A visor core 5 made of synthetic resins is positioned at the center of the cap visor 4, a upper cloth 7 and a lower cloth 8 with the same size as areas of the visor core 5 are positioned on the upper and the lower surfaces of the visor core 5, respectively and a rim cloth 9 is sewed to fix edges of the upper cloth 7 and the lower cloth 8. A rear part of the cap visor 4 positioned at a wearer's forehead in wearing the cap 1 is sewed to the cap body 3 for fixing.

However, in order to keep the cap 1 having the aforementioned structure, the cap 1 must be kept in a space with a size more over an area of the cap visor 4. This is because the cap visor 4 must be bent to keep the cap 1 in a smaller space, so that the visor core 5 made of synthetic resins is deformed to deform the shape of the cap 1 if the cap 1 is kept in the smaller space.

SUMMARY OF THE INVENTION

Therefore, the present invention is made in order to solve the aforementioned problems.

An object of the present invention is to provide a cap having a foldable visor, which is capable of being conveniently kept and carried and which is capable of forming a purse for keeping a small object.

The above object can be accomplished by a cap having a foldable visor according to the present invention, the cap having a visor comprising a visor core and cloth fixed to a upper surface and a lower surface of the visor core, the visor located at a wearer's forehead when the wearer wears the cap, wherein said visor core is divided into a plurality of pieces and is foldable about the dividing portions of the visor core.

It is preferable that each cloth with sizes of said divided pieces of said visor core is fixed to one surfaces of the upper and lower surfaces of said divided pieces of said visor core, and a cloth with a total size of said divided pieces of said visor core in a state that said divided pieces of said visor core are adjacent to each other is fixed to the other surfaces of the upper and lower surfaces of said divided pieces of said visor core, so that a gap is formed between said divided pieces of said visor core and said cloth with a total size of said divided pieces of said visor core.

It is more preferable that said visor core is divided into two pieces, said visor core being symmetrically divided from a portion where the dividing portion of said visor core meets the wearer's forehead to the wearer's front.

Also, it is more preferable that each upper cloth with sizes of said divided pieces of said visor core is fixed to upper surfaces of said divided pieces of said visor core, a first rim members is sewn at the dividing portion of said visor core to surround said divided pieces and said upper cloth, a lower cloth with a total size of said divided pieces of said visor core in a state that said divided pieces of said visor core are adjacent to each other is fixed to the lower surfaces of said divided pieces of said visor core, and a second rim member is sewn to surround said lower cloth and edges of the divided pieces of said visor core, so that a gap is formed between said divided pieces of said visor core and said lower cloth.

BRIEF DESCRIPTION OF THE DRAWINGS

The embodiments of the present invention will be explained with reference to the accompanying drawings, in which.

DETAILED DESCRIPTION OF THE INVENTION

The above object, other objects, features and advantages of the present invention will be better-understood from the following description taken in conjunction with the attached drawings.

Now, preferred embodiments of the present invention will be described in detail with reference to the drawings.

First Embodiment

Figure 1:
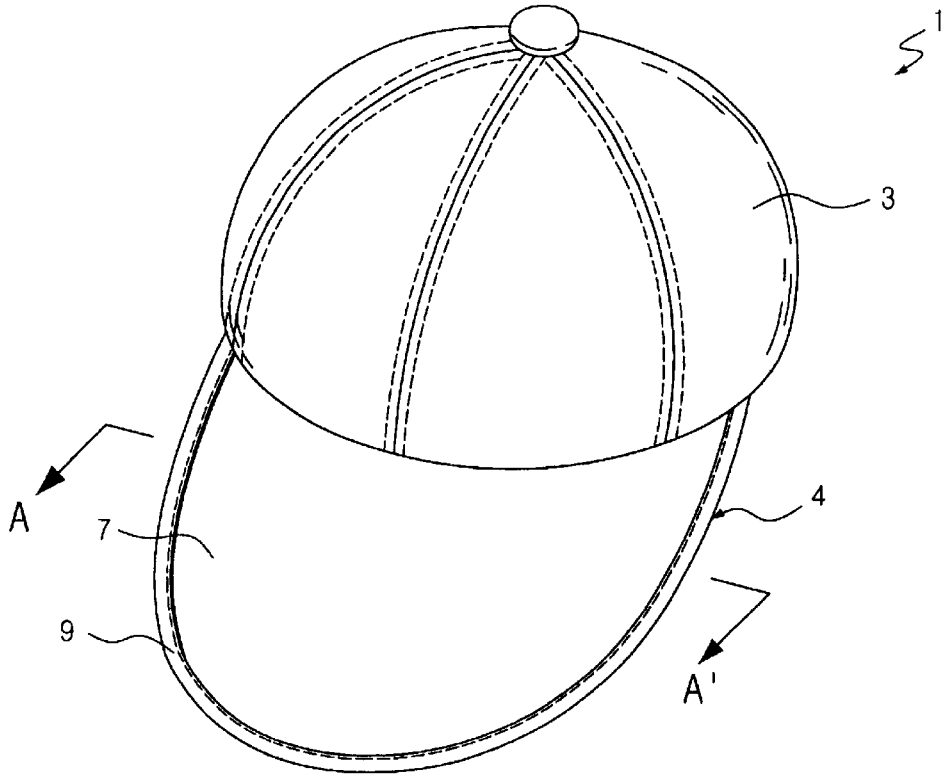
FIG. 1 is a perspective view of a cap according to the conventional art.
Figure 2:
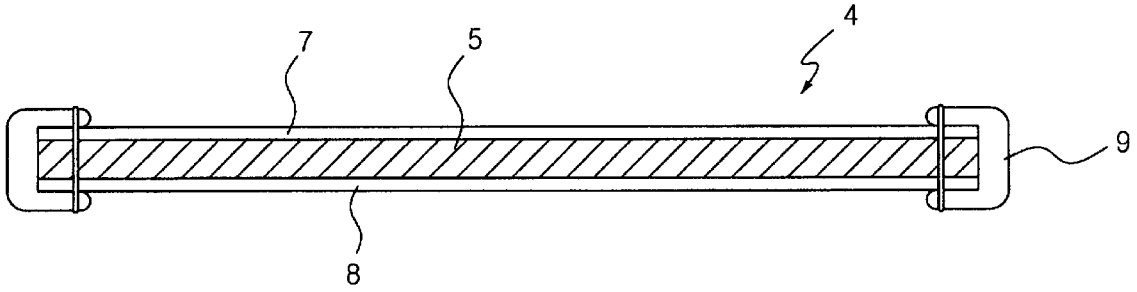
FIG. 2 is a cross-sectional view taken along line A–A' of the cap visor shown in FIG. 1.
Figure 3:
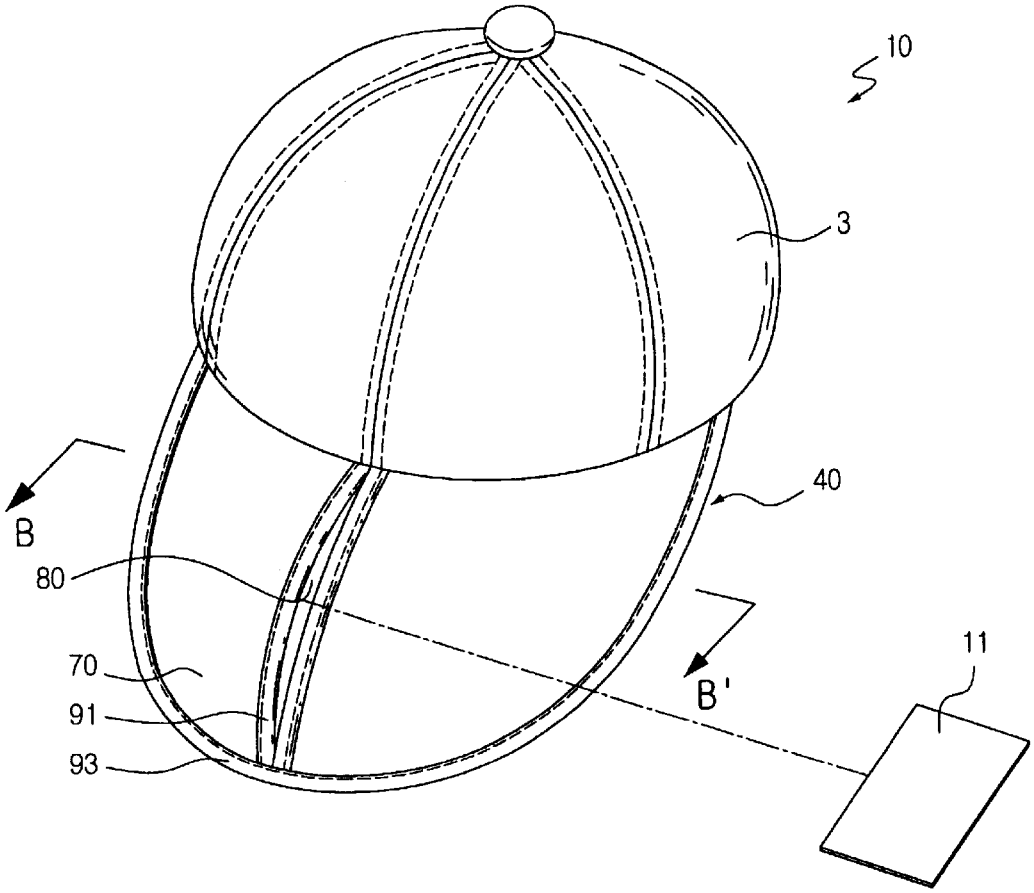
FIG. 3 is a perspective view of a cap having a foldable visor according to a first embodiment of the present invention.
Figure 4:
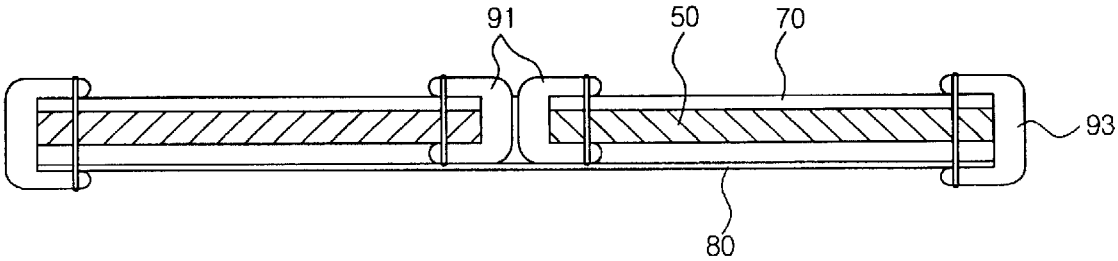
FIG. 4 is a cross-sectional view taken along line B–B' of the cap shown in FIG. 3.
Figure 5:
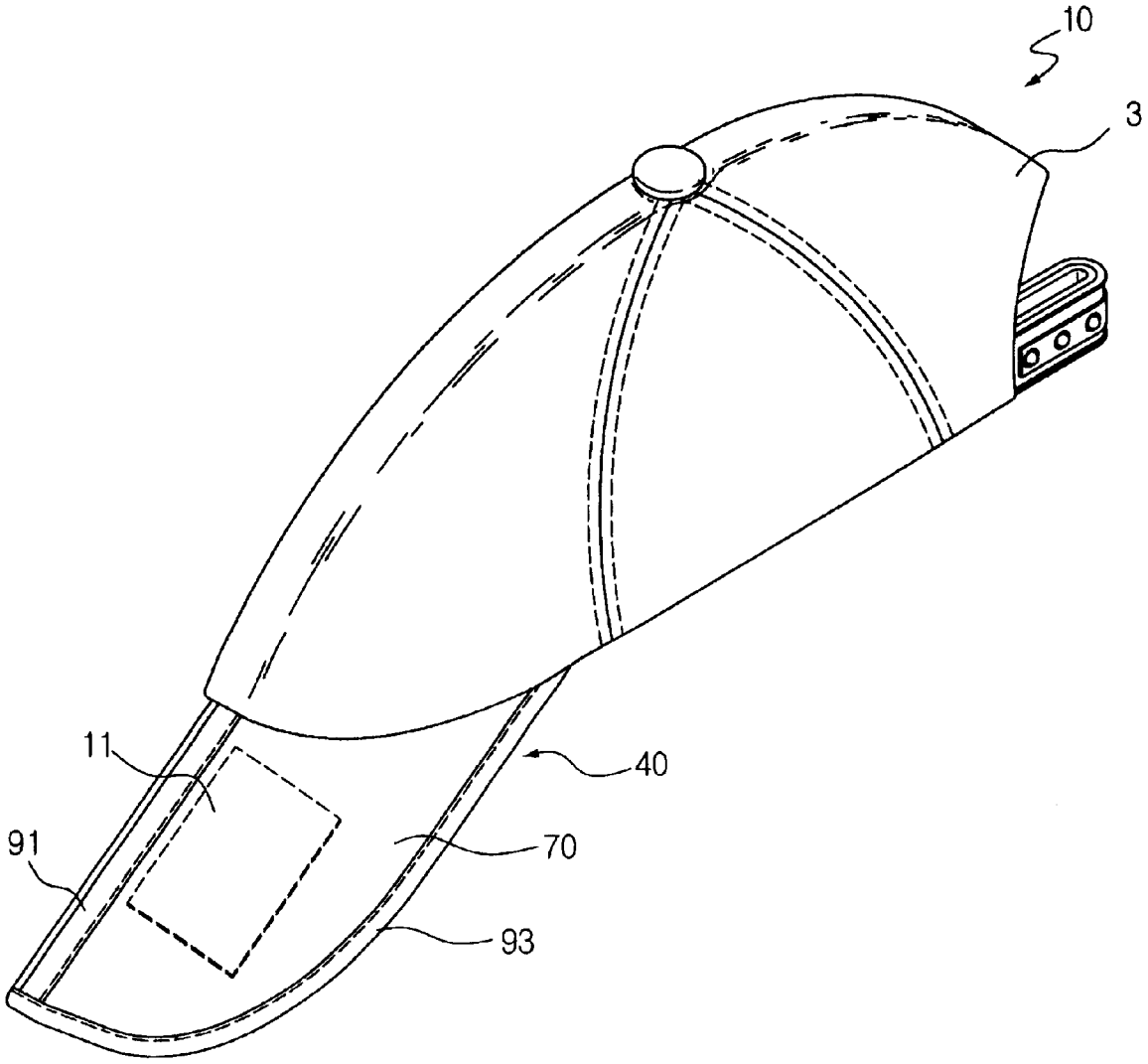
FIG. 5 is a perspective view illustrating a folded state of the cap shown in FIG. 3.

FIG. 3 is a perspective view of a cap having a foldable visor according to a first embodiment of the present invention, FIG. 4 is a cross-sectional view taken along line B–B' of the cap shown in FIG. 3 and FIG. 5 is a perspective view illustrating a folded state of the cap shown in FIG. 3;

As shown in FIG. 3 through FIG. 5, the visor core 50 of the cap visor 40 is cut from the center of the rear portion of the visor cap 40 sewed to the cap body 3 toward the front of the visor cap 40, that is, from the wearer's forehead toward the front of the wearer when wearing the cap 10. Therefore, the two cut visor cores 50 have the same shape and if the cut surfaces of the two cut visor cores are positioned to be adjacent to each other, the visor cores 50 have the same size and shape as the size and the shape of the visor core 5 of the conventional cap 1 (see FIG. 1).

Upper cloths 70 with sizes of the respective visor cores 50 are positioned on the upper surfaces of the two visor cores 50. A first rim cloths 91 are sewed to surround edges of the visor cores 50 and the upper cloths 70 along the cut surfaces and to fix the first rim cloth 91 positioned on the cut surfaces of the two visor cores 50, the visor cores 50 and edges of the upper cloths 70. In a state that the first rim cloths 91 sewed on the two visor cores 50 are adjacent to each other, a lower cloth 80 with the total area of the two visor cores 50 is positioned on the lower surfaces of the two visor cores 50 and a second rim cloth 93 surrounds edges of the upper cloths 70, the two visor cores 50 and the lower cloth 80. At that time, the second rim cloth 93 surrounds the front and lateral portions of the visor cores 50, that is, edges of the visor cores 50 except for a surface adjacent to the cap body 3 and the cut surface of the visor cores 50 and then is sewed.

In this state, a rear portion of the cap visor 40 not sewed is sewed on the cap body 3 to be fixed.

When the cap with the foldable visor formed like this is to be kept or inserted into a gap, the wearer pivots the two visor cores 50 downward on the cut surfaces of the two visor cores 50 to be adjacent to each other. Then, by means of pivot of the visor cores 50 made of synthetic resins, the cap body 3 with hemispherical shape is folded half with reference to the cut surfaces of the two visor cores 50. At that time, the cap 10 is converted from solid structure to plane structure. Therefore, the cap 10 can be kept in a small gap and a small and thin object such as card 11 can be inserted into a gap between the visor cores 50 and the lower cloth 80 to be kept.

In order to put on the cap 10 folded like this, the two visor cores 50 pivoted downwards are pivoted upwards to unfold the lower cloth 80. Then, by means of pivot of the visor cores 50, the cap body 3 is folded half is unfolded to form the original hemispherical shape. At that time, as the two visor cores 50 folded half to be kept is not deformed in shape, the original shape of the cap 10 remains unchanged when the cap is worn.

Although a cap in a state that the first rim cloths 91 sewed on the two visor cores are adjacent to each other is explained above, the object and advantages of the present invention can be accomplished by a cap having two visor cores 50 10 cm apart.

Second Embodiment

Although the first embodiment relates to a cap having a cap visor fixed to a hemispherical cap body, a cap having a foldable visor according to the present invention is not limited thereto and can be adapted to a sunshade cap that is worn by pressing the periphery of head.

A sunshade cap according to a second embodiment of the present invention has the same cap visor as the cap visor according to the first embodiment of the present invention and only its cap body is reformed. The equal or similar reference numbers are assigned to equal elements and the detailed explanation thereof is omitted.

Figure 6:
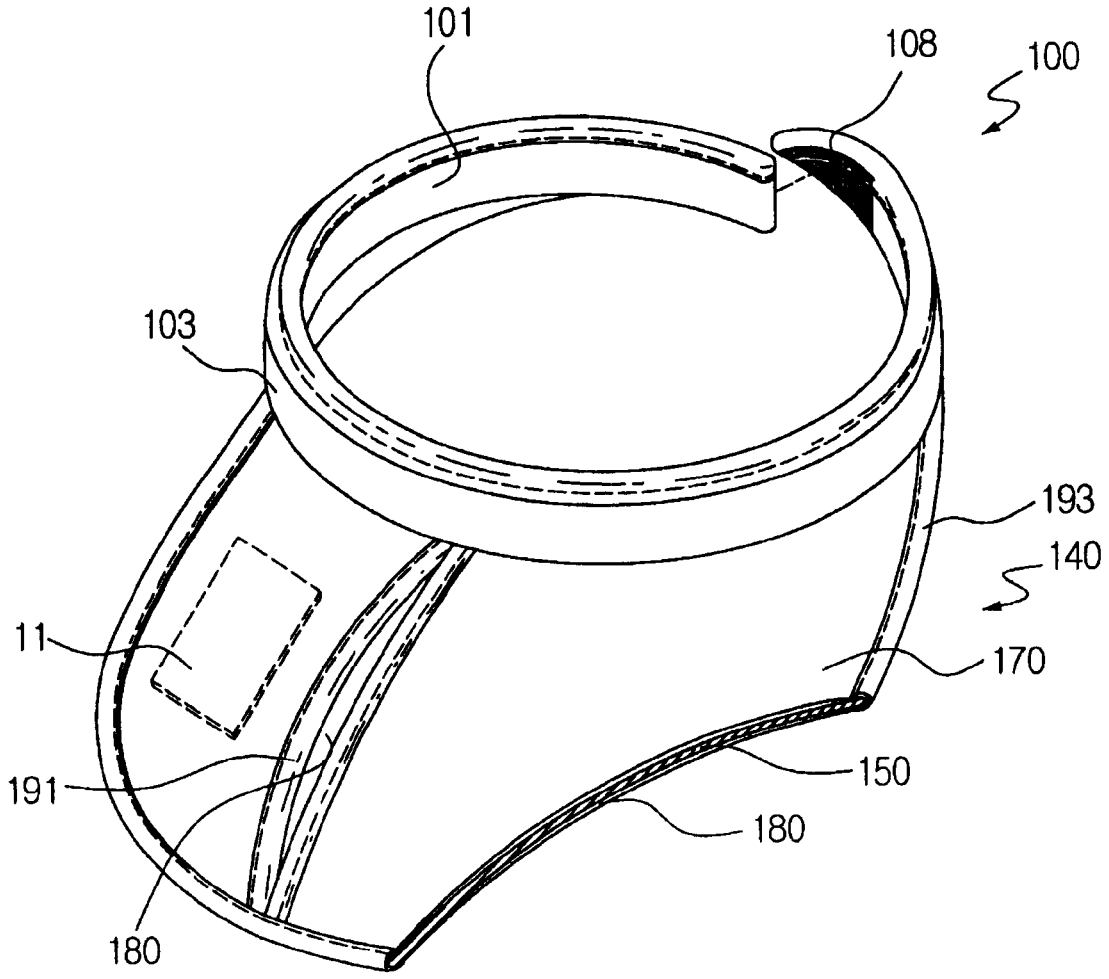
FIG. 6 is a rough view of a sunshade cap having a foldable visor according to a second embodiment of the present invention.
Figure 7:
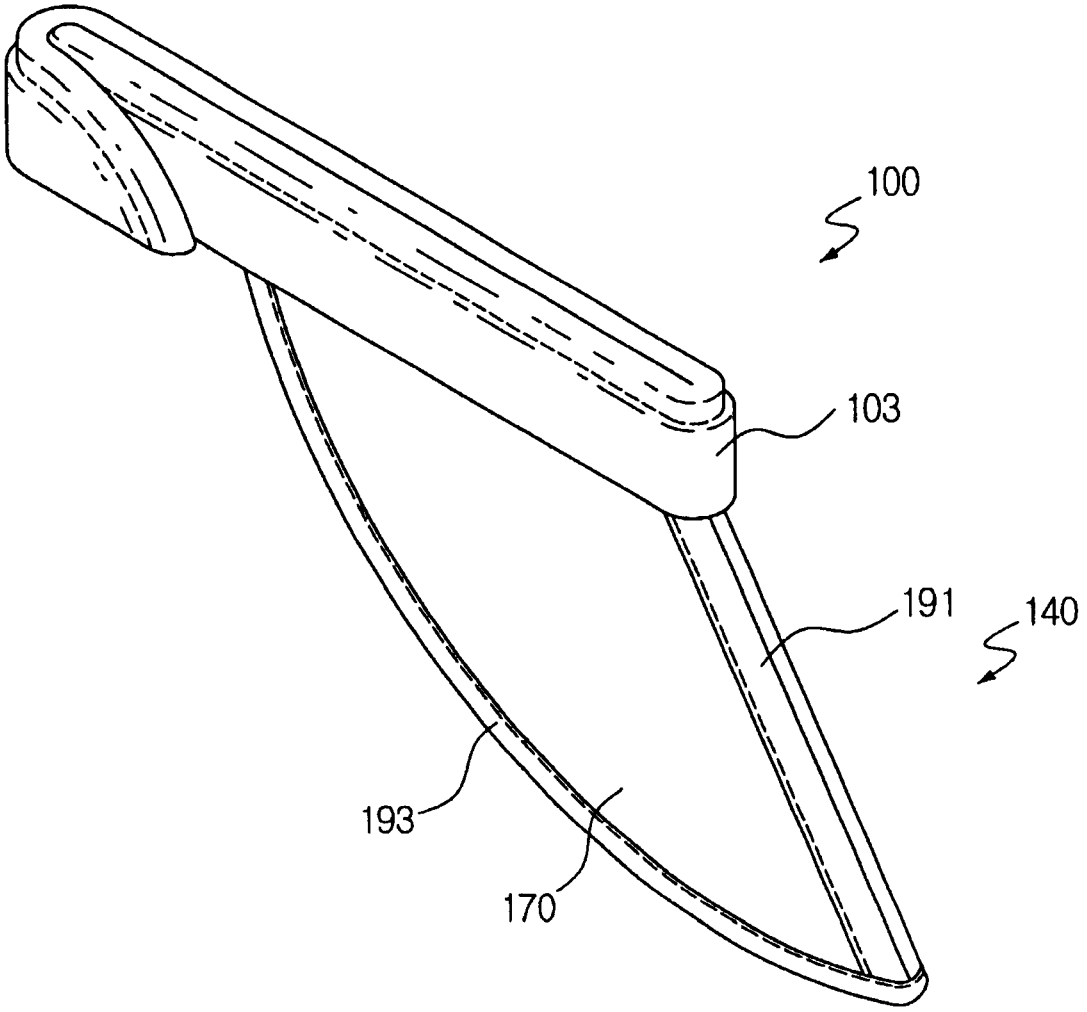
FIG. 7 is a perspective view illustrating a folded state of the sunshade cap shown in FIG. 6.

FIG. 6 is a rough view of a sunshade cap having a foldable visor according to a second embodiment of the present invention and FIG. 7 is a perspective view illustrating a folded state of the sunshade cap shown in FIG. 6.

As shown in FIG. 6 FIG. 7, the sunshade cap 100 includes a brim portion 103 surrounding the periphery of a wearer's head and a cap visor 140 positioned toward the front of the wearer's forehead in wearing the sunshade cap 100, and the cap visor 140 is sewed on the brim portion 103.

The cap visor 140 includes two visor cores 150, upper cloths 170 positioned on upper surfaces of the respective visor cores 150, a lower cloth 180 positioned on lower surfaces of the two visor cores 150, first rim cloths 191 sewed to fix edges of the visor cores 150 and the upper cloths 170, and a second rim cloth 193 sewed to fix edges of the visor cores 150, the upper cloths 170 and the lower cloth 180.

A soft cloth 101 capable of being folded and unfolded well is positioned within the brim portion 103, the same cloth as the upper cloths 170 and the lower cloth 180 is positioned on the opposite surface to the soft cloth 101 of the brim portion 103 to be sewed on the soft cloth 101 to form the brim portion 103. Therefore, the brim portion 103 can be easily folded and unfolded. A hook part 108 of Velcro fastener is sewed on an inner part of one end of the brim portion 103 and a loop part (not shown) of Velcro fastener is sewed on an outer part of the other end of the brim portion 103. Therefore, by coupling the hook part 108 and the loop part of the brim portion 103 after positioning the cap visor 140 at the wearer's forehead and having the wearer's head surrounded by the brim portion 103, the sunshade cap 100 is prevented from being separated from the wearer's head.

In order to keep the sunshade cap 100, the two visor cores 150 are downward pivoted and then the brim portion 103 is folded half at the same time of pivoting the visor cores 150. In order to put on the sunshade cap 100, the two visor cores 150 are upward pivoted and then the brim portion 103 is unfolded to have the original ring shape. In such sunshade cap 100, a small and thin object such as card 11 can be inserted into a gap between the two visor cores 150 and the lower cloth 180 to be kept.

Third Embodiment

A cap according to a third embodiment of the present invention includes the same elements of a cap according to the first embodiment of the present invention. A cap according to a third embodiment of the present invention is equal to the first embodiment of the present invention, except for a gap formed between the two visor cores and the upper cloth for keeping cards. The equal or similar reference numbers are assigned to equal elements and the detailed explanation thereof is omitted.

Figure 8:
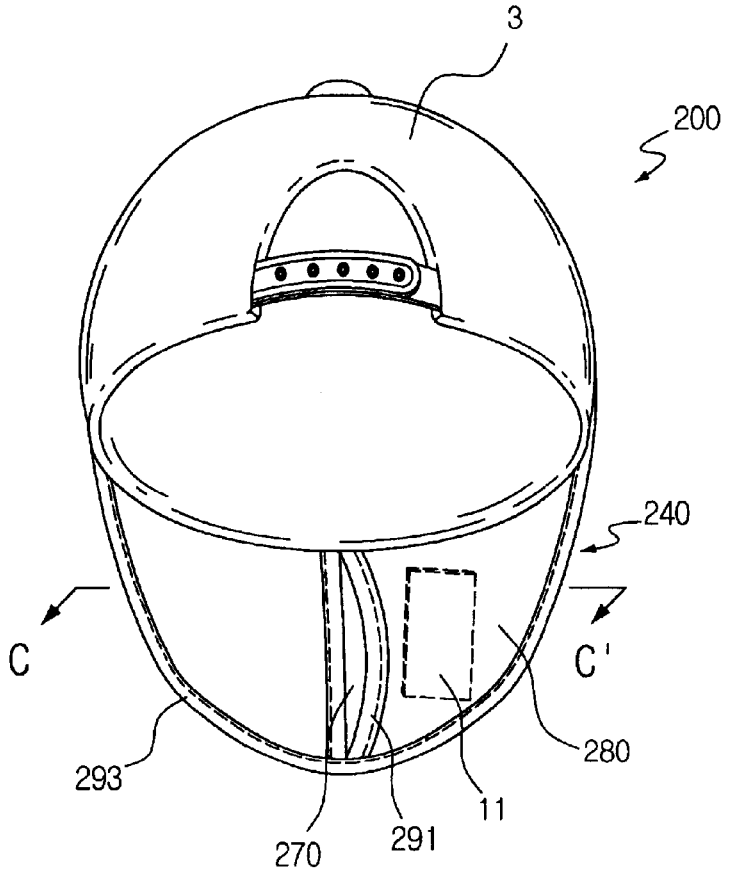
FIG. 8 is a perspective view of a cap having a foldable visor according to a third embodiment of the present invention.
Figure 9:
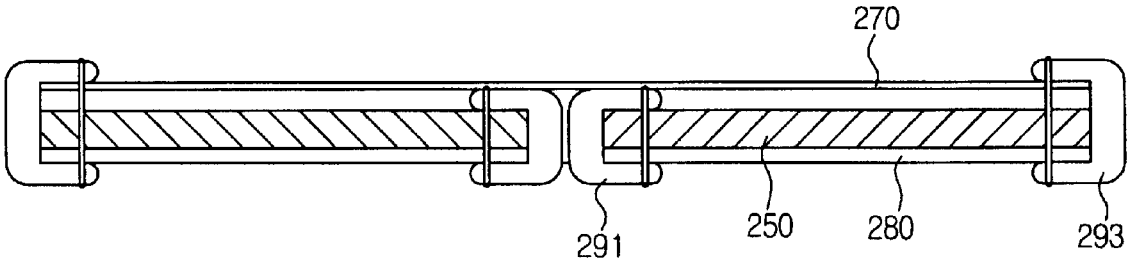
FIG. 9 is a cross-sectional view taken along line C–C' of the cap shown in FIG. 8.

FIG. 8 is a perspective view of a cap having a foldable visor according to a third embodiment of the present invention, and FIG. 9 is a cross-sectional view taken along line C–C' of the cap shown in FIG. 8.

As shown in FIG. 8 and FIG. 9, lower cloths 280 with sizes of the respective visor cores 250 are sewed on the two visor cores 250 with first rim cloths 291, and a upper cloth 270 with the total size of the two visor cores 250 is positioned on the upper surfaces of the visor cores 250. Edges of the two visor cores 250, the upper cloth 270 and the lower cloths 280 are sewed with a second rim cloth 293.

Therefore, when the two visor cores 250 are folded, the cap 200 also is folded. A small and thin object such as card 11 can be inserted into a gap between the two visor cores 250 and the upper cloth 270 to be kept.

As described above in detail, a cap having a foldable visor according to the present invention can be folded for convenient keeping and carrying, and can return to the original shape without the cap visor crumpled in putting on the cap.

Also, a gap is formed between the visor core and the lower cloth or between the visor core and the upper cloth, so that a small and thin object such as card 11 can be inserted into the gap to be kept.

Although technical spirits of the present invention has been disclosed with reference to the appended drawings and the preferred embodiments of the present invention corresponding to the drawings has been described, descriptions in the present specification are only for illustrative purpose, not for limiting the present invention.

Also, those who are skilled in the art will appreciate that various modifications, additions and substitutions are possible without departing from the scope and spirit of the present invention. Therefore, it should be understood that the present invention is limited only to the accompanying claims and the equivalents thereof, and includes the aforementioned modifications, additions and substitutions.

What is claimed is:

1. A cap having a visor comprising a visor core, the visor for being located at a wearer's forehead portion when the wearer wears the cap, said visor core being divided into two sections each having an upper and lower surface, and first and second pieces of cloth respectively having a size corresponding to a size of said divided sections of said visor core are fixed to one of the upper and the lower surfaces of said divided sections of said visor core, and a third piece of cloth having a size corresponding to a total size of said divided sections of said visor core when said divided sections of said visor core are positioned adjacent to each other, the third piece of cloth being fixed to the other of the upper and lower surfaces of said divided sections of said visor core opposing the surface where said first and second pieces of cloth are fixed to, so that a gap is formed between said divided sections of said visor core and said third piece of cloth having the size corresponding to the total size of said divided sections of said visor core.

2. The cap according to claim 1, wherein said visor core is symmetrically divided and foldable about a portion where said visor core is divided.

3. The cap according to claim 1, wherein said first and second pieces of cloth respectively have the size corresponding to the size of said divided sections of said visor core are fixed to the upper surface of said divided sections of said visor core, a first rim member is sewn at a divided portion of said visor core to surround said visor core and the first and second pieces of cloth fixed to the upper surface of said visor core, said third piece of cloth being fixed to the lower surface of said divided sections of said visor core, and a second rim member is sewn to surround said third piece of cloth fixed to the lower surface of said visor core and outer edges of said divided sections of said visor core, so that a gap is formed between said divided sections of said visor core and said third piece of cloth fixed to the lower surface of said visor core.

* * * * *